United States Patent [19]

Chatman

[11] 4,153,183

[45] May 8, 1979

[54] ICE CUBE DISPENSING DEVICE

[76] Inventor: Arbery G. Chatman, 8639 Jennings Rd., 8639 Jennings Rd., Mo. 63136

[21] Appl. No.: 840,289

[22] Filed: Oct. 7, 1977

[51] Int. Cl.[2] ..... B67D 5/06

[52] U.S. Cl. ..... 222/185; 222/450; 222/461; 222/482; 222/523; 222/525; 222/532; 141/337

[58] Field of Search ..... 222/460, 461, 464, 523–525, 222/528, 531, 532, 537, 538, 181, 185, 450, 361, 482, 566; 141/337, 331, 339, 340

[56] References Cited

U.S. PATENT DOCUMENTS

| | | | |
|---|---|---|---|
| 247,855 | 10/1881 | Smalley | 222/523 |
| 1,660,442 | 2/1928 | Hampton | 141/337 X |
| 3,132,768 | 5/1964 | Orr | 222/461 X |

*Primary Examiner*—Robert J. Spar

*Assistant Examiner*—Charles A. Marmor

*Attorney, Agent, or Firm*—Daniel Jay Tick

[57] ABSTRACT

A funnel type container is mounted above a bar with its axis vertical. A stop member is mounted on a cross member in the container at the open top thereof and extends coaxially toward the bottom in spaced relation therewtih. A plurality of tubular members are telescopically slidably coupled to each other. One of the tubular members is slidable coupled to the open bottom of the container and extends therethrough whereby in extended position the tubular members extend a maximum distance from the container and direct ice cubes stored in the container to glasses on the bar. In a withdrawn position, the one of the tubular members extends into the container and abuts the stop member thereby blocking the bottom of the container and preventing ice cubes from leaving the container.

2 Claims, 4 Drawing Figures

ICE CUBE DISPENSING DEVICE

BACKGROUND OF THE INVENTION

The present invention relates to an ice cube dispensing device. More particularly, the invention relates to an ice cube dispensing device for a bar having a serving surface and a work surface behind the serving surface and at a lower height than the serving surface.

Objects of the invention are to provide an ice cube dispensing device of simple structure, which is inexpensive in manufacture, installed and used with facility and convenience, and functions efficiently, effectively and reliably to dispense any desired number of ice cubes to any desired number of glasses, or the like, in very short periods of time.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
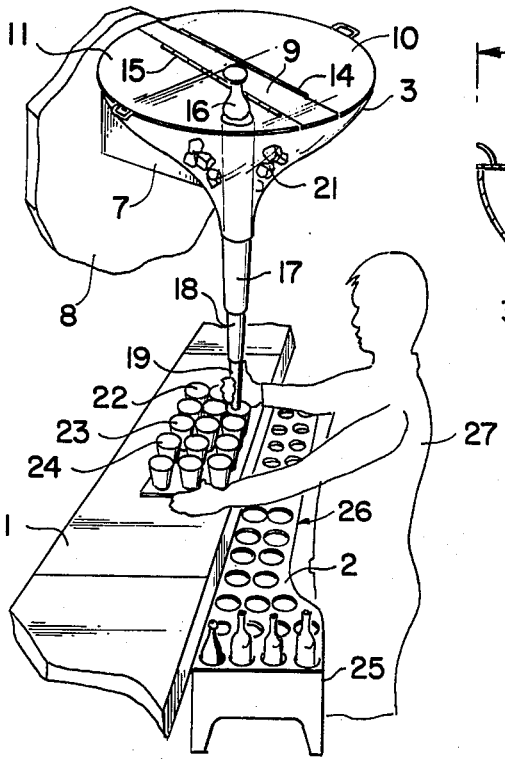
FIG. 1 is a perspective view of an embodiment of the ice cube dispensing device of the invention in use.

The ice cube dispensing device of the invention is for a bar having a serving surface 1 (FIG. 1) and a work surface 2 (FIGS. 1 and 4) behind the serving surface at a lower height than the serving surface, as shown in FIG. 1.

Figure 2:
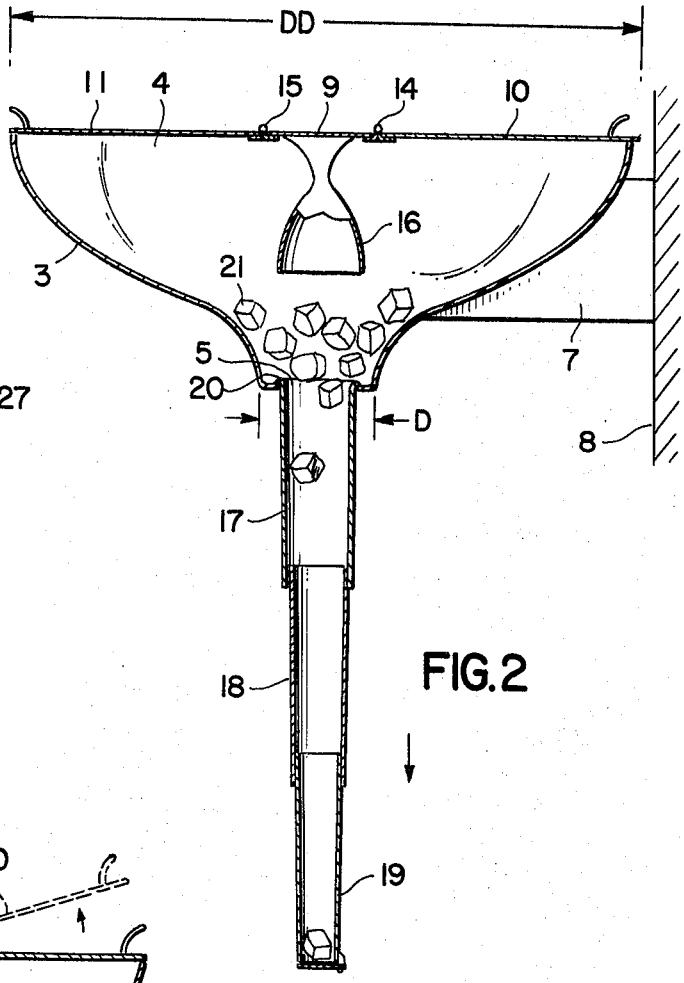
FIG. 2 is a view, on an enlarged scale, partly cut away and partly in section, of the embodiment of FIG. 1 in extended position.

The ice cube dispensing device of the invention comprises a funnel type container 3 (FIGS. 1 to 3) having an open top 4 of predetermined diameter DD (FIG. 2) and tapering down to an open bottom 5 of considerably smaller diameter D than the predetermined diameter (FIG. 2).

Figure 3:
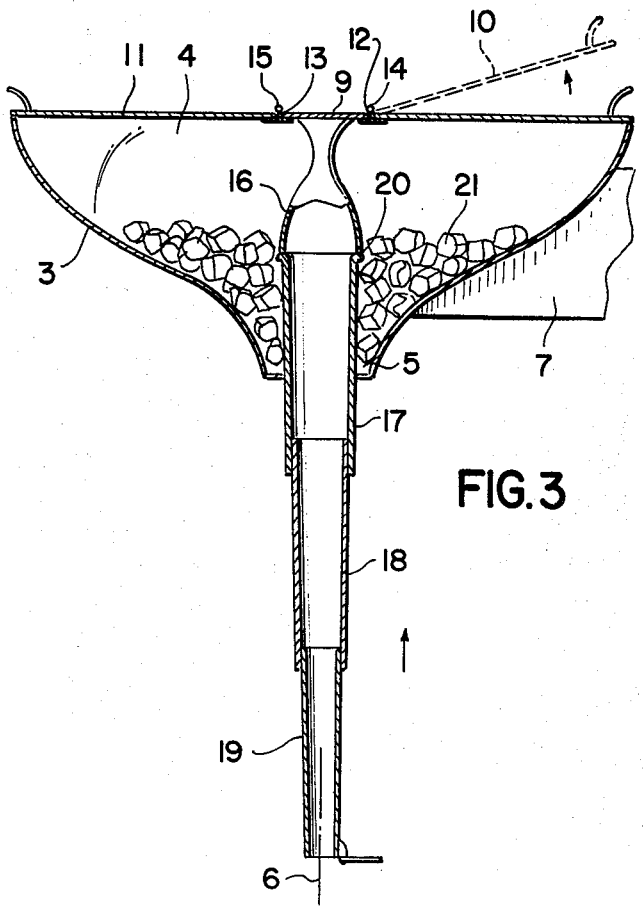
FIG. 3 is a view, on an enlarged scale, partly cut away and partly in section, of the embodiment of FIG. 1 in withdrawn position.

As shown in FIGS. 1 to 3, the container 3 is mounted above the bar 1 with its axis 6 (FIG. 3) substantially vertical. The container 3 is mounted by an suitable device such as, for example, a structural member 7 (FIGS. 1 to 3) affixed to and extending from a wall 8 (FIGS. 1 and 2).

A cross member 9 is affixed to the top 4 of the container and extends diametrically thereacross, as shown in FIGS. 1 to 3. A pair of covers 10 and 11 are hingedly affixed to opposite longitudinal edges 12 and 13, respectively (FIG. 3), of the cross member 9 for selectively opening and closing the top 4. The covers 10 and 11 are affixed to the cross member 9 by any suitable hinges or groups of hinges 14 and 15, respectively (FIGS. 1 to 3).

A stop member 16 is affixed to the cross member 9 in the container 3 and extends coaxially toward the bottom 5 of the container, but is spaced from said bottom, as shown in FIGS. 1 to 3.

A plurality of tubular members 17, 18 and 19 are telescopically slidably coupled to each other in a known manner, as shown in FIGS. 1 to 3. The tubular member 17 is slidably coupled to the container 3, as shown in FIGS. 1 to 3 and extends through the open bottom 5 thereof. The tubular member 17 is retained by a collar or lip 20 (FIGS. 2 and 3) at the bottom 5 of the container 3 when it is fully extended from said container.

In extended position, the tubular members 17, 18 and 19 extend a maximum distance from the container 3, as shown in FIGS. 1 and 2, and direct ice cubes 21 stored in the container to glasses 22, 23, 24, and so on, on the bar 1, as shown in FIG. 1. In a withdrawn position, the tubular member 17 extends into the container 3 and abuts the stop member 16 thereby blocking the container and preventing ice cubes 21 from leaving the container, as shown in FIG. 3.

The work surface 2 has an inner edge 25 spaced from the serving surface 1 of the bar, as shown in FIG. 1. In accordance with another feature of the invention, the inner edge 25 of the work surface 2 of the bar has an indentation 26 formed therein to permit a bartender 27 to stand closer to the serving surface of the bar, as shown in FIG. 1.

Figure 4:
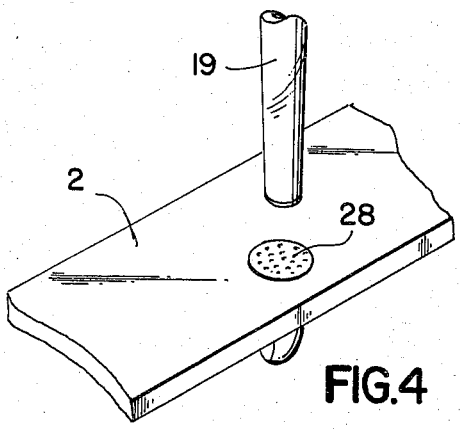
FIG. 4 illustrates the positioning of the ice cube dispensing device of the invention relative to a drain in the work surface of a bar serviced by the dispensing device.

The ice cube dispensing device of the invention is preferably mounted so that it is positioned directly over a drain 28 in the work surface 2 of the bar, as shown in FIG. 4.

The ice cube dispensing device of the invention is useful in hotels and restaurants, especially when banquets are served. The dispensing device of the invention is useful when rapid service is required in any eating place having a large turnover of customers.

While the invention has been described by means of a specific example and in a specific embodiment, I do not wish to be limited thereto, for obvious modifications will occur to those skilled in the art without departing from the spirit and scope of the invention.

Devices of the type described in the present application are disclosed in the following United States patent. U.S. Pat. No. 1,478,754, issued to Morre on Dec. 25, 1923, U.S. Pat. No. 2,200,642, issued to Shell on May 14, 1940, U.S. Pat. No. 3,300,094, issued to Rockola on Jan. 24, 1967 and U.S. Pat. No. 3,537,623, issued to Fisher on Nov. 3, 1970.

I claim:

1. An ice cube dispensing device for a bar having a serving surface and a work surface behind the serving surface and at a lower height than the serving surface, said ice cube dispensing device comprising a funnel type container having an open top of predetermined diameter and tapering down to an open bottom of considerably smaller diameter than the predetermined diameter, said container being mounted above a bar with its axis substantially vertical;

a cross member affixed to the top of the container and extending diametrically thereacross;

a pair of covers hingedly affixed to opposite longitudinal edges of the cross member for selectively opening and closing the top;

a stop member affixed to the cross member in the container and extending coaxially toward the bottom but spaced therefrom; and a plurality of tubular members telescopically slidably coupled to each other, one of said tubular members being slidably coupled to the container and extending through the open bottom thereof whereby in extended position the tubular members extend a maximum distance from the container and direct ice cubes stored in the container to glasses on the bar and in a withdrawn position said one of said tubular members extends into the container and abuts the stop member thereby blocking the bottom of the container and preventing ice cubes from leaving the container.

2. An ice cube dispensing device as claimed in claim 1, wherein the work surface has an inner edge spaced from the serving surface and said inner edge has an indentation formed therein to permit a bartender to stand closer to the serving surface of the bar.

* * * * *